US005396946A

United States Patent [19]

Andoh

[11] Patent Number: 5,396,946

[45] Date of Patent: Mar. 14, 1995

[54] LOW PRESSURE CASTING MACHINE

[75] Inventor: Kouiti Andoh, Kawasaki, Japan

[73] Assignee: Fuji Electric Co., Ltd., Kanagawa, Japan

[21] Appl. No.: 53,136

[22] Filed: Apr. 29, 1993

[30] Foreign Application Priority Data

May 8, 1992 [JP] Japan ..... 4-115038

[51] Int. Cl.[6] ..... B22D 18/04

[52] U.S. Cl. ..... 164/306; 164/337

[58] Field of Search ..... 164/513, 306, 309, 337

[56] References Cited

U.S. PATENT DOCUMENTS

| | | | |
|---|---|---|---|
| 1,913,945 | 6/1933 | Morris et al. | 164/309 |
| 1,952,201 | 3/1934 | Flammang et al. | 164/309 |
| 2,018,586 | 10/1935 | Wetherill, Jr. et al. | 164/309 |
| 2,997,756 | 8/1961 | Strom | 164/309 X |
| 3,358,746 | 12/1967 | Crowe | 164/306 |
| 3,450,190 | 6/1969 | Mittermaier et al. | 164/309 |
| 3,529,753 | 9/1970 | Mack | 164/306 X |
| 3,858,641 | 1/1975 | Kirby, Jr. et al. . | |
| 3,874,440 | 4/1975 | Voisin | 164/306 |
| 4,103,734 | 8/1978 | Mikotin et al. | 164/309 |
| 4,693,292 | 9/1987 | Campbell . | |

FOREIGN PATENT DOCUMENTS

| | | |
|---|---|---|
| 0193071 | 9/1986 | European Pat. Off. . |
| 1783046 | 2/1971 | Germany . |
| 1583572 | 3/1977 | Germany . |
| 3214922 | 11/1983 | Germany . |
| 3409995 | 3/1985 | Germany . |
| 3619525 | 8/1987 | Germany . |
| 3815828 | 11/1988 | Germany . |
| 1217282 | 12/1970 | United Kingdom . |
| 1386803 | 3/1975 | United Kingdom . |
| 2016879A | 9/1979 | United Kingdom . |
| 1348061 | 10/1987 | U.S.S.R. . |

*Primary Examiner*—J. Reed Batten, Jr.
*Attorney, Agent, or Firm*—Finnegan, Henderson, Farabow, Garrett & Dunner

[57] ABSTRACT

A crucible 2 for holding a molten metal 1 is stored in a crucible chamber 5 which comprises a lid 3 and a chamber body 4 connected airtightly to each other. In the lid 3, there are provided an openable/closable molten metal supply opening 6 through which a cold metal charge is thrown in and a molten metal is received from a melting furnace, and a pipe-shaped stoke 7 which extends through the lid 3 and rises from the bottom portion of the crucible 2. The stoke 7 includes on the top end portion thereof a joint 9 which can be connected to a metal mold 8. To the crucible chamber 5, there are connected a pressure pipe 10 which is used to apply pressure to the crucible chamber 5 to thereby pour the molten metal to a metal mold, and an exhaust pipe 11 which is used to discharge the air of the crucible chamber 5 therefrom to thereby stop the pouring of the molten metal. In the outer periphery of the crucible 2, there is provided an induction heating device 14 which comprises a coil 12 wound round the crucible 2 and a plurality of yokes 13 disposed in the circumferential direction of the outer periphery of the crucible 2.

10 Claims, 1 Drawing Sheet

LOW PRESSURE CASTING MACHINE

BACKGROUND OF THE INVENTION

The present invention relates to a low pressure casting machine for casting copper alloy and, in particular, to a low pressure casting machine suitable for brass castings which are small in size and large in the number of lots.

In a conventional low pressure casting machine, a crucible for storing molten copper alloy such as molten brass is accommodated in a crucible chamber consisting of a lid and a chamber body which are airtightly connected to each other. The lid includes a molten copper alloy supply opening which can be airtightly opened or closed for receiving molten copper alloy from a melting furnace, and a pipe-shaped stoke which extends through the lid and rises from the bottom portion of the crucible. The stoke includes on the top end portion thereof a joint which can be connected with a metal mold. To the lid is connected a common pipe which connects, in parallel, a pressure pipe for applying pressure to the crucible chamber to thereby pour the molten copper alloy into the metal mold with an exhaust pipe for exhausting the air from the crucible chamber to thereby stop the pouring of the molten copper alloy. Further, the conventional crucible does not include any induction heating device but the above-mentioned molten copper alloy is kept hot by a heat insulator.

To pour the molten copper alloy into the metal mold, the molten copper alloy at suitable temperatures is poured from the melting furnace through the molten copper alloy supply opening into the crucible to the brim. The supply opening is then closed airtightly, and the metal mold is put on the joint disposed on the top end portion of the stoke. If the crucible chamber is given pressure through the common pipe from a gas pressure source, then, due to the principle of a siphon, the molten copper alloy moves upwardly through the stoke by the pressure that is applied onto the surface of the molten copper alloy within the crucible, so that the molten copper alloy is poured into the metal mold. After completion of pouring of the molten copper alloy, if the common pipe is opened to the atmosphere through the exhaust pipe, then the crucible chamber is returned to the atmospheric pressure so that the molten copper alloy in the stoke moves back into the crucible. Then, the metal mold is replaced with a new mold and, similarly, the pressuring and exhausting operations are performed repeatedly to thereby pour the molten copper alloy into a plurality of metal molds sequentially. As the surface of the molten copper alloy in the crucible is lowered, the pressuring forces are increased sequentially. If the molten copper alloy in the crucible is decreased, or if the temperature of the molten copper alloy reaches the lower limit of a range of temperatures suitable for casting, then the molten copper alloy at suitable temperatures is poured again from the melting furnace through the supply opening into the crucible.

In the above-mentioned conventional low pressure casting machine, when the metal to be casted is an aluminum alloy or brass, there can be obtained a wide range of casting temperature having allowable values, including the upper and lower limit values of temperatures suitable for casting of the molten metal. Likewise, when a metal mold is large in size and a piece of casting is large in weight, the molten metal poured from the melting furnace into the crucible to the brim is used out before the temperature of the molten metal in the crucible is lowered down to the lower limit of the casting temperature allowable values. Therefore, the low pressure casting machine using a metal mold provides a good operation efficiency. However, when the metal mold is small in size and a piece of casting is small in weight, because the molten metal pouring tact is not shortened so much, the temperature of the molten metal poured into the crucible to the brim is lowered down to the lower limit of the casting temperature allowable values before the molten metal is depleted. In view of this, it is necessary to replenish again the molten metal at high temperatures from the melting furnace while the previously poured molten metal is left half in the crucible, which requires an additional time. That is, the loss of time for the replenishing operation worsens the operation efficiency of the low pressure casting machine.

Conventionally, water service items such as a water tap and the like were originally made of bronze. In recent years, however in addition to the bronze, use of brass has also been permitted. In metallurgy, bronze is not suitable for casting by a low pressure casting machine using a metal mold and, for this reason, there is seen a tendency to produce a small-sized brass casting by use of a low pressure casting machine using a metal mold with high efficiency.

SUMMARY OF THE INVENTION

In view of the above, the present invention aims at eliminating the drawbacks found in the conventional low pressure casting machine. Accordingly, it is an object of the invention to provide a low pressure casting machine which, when casting a small-sized brass casting by use of a metal mold under low pressure, prevents the temperature of molten brass poured into even a large-sized crucible from being lowered down to the lower limit of casting temperature allowable values before the molten brass in depleted.

In achieving the above object, according to the invention, there is provided a low pressure casting machine which includes a crucible for holding a molten copper alloy, a crucible chamber for storing the crucible therein and consisting of a lid and a chamber body airtightly connected to each other, a molten copper alloy supply opening formed in the lid in such a manner that it can be airtightly opened and closed, a pipe-shaped stoke extending through the lid and rising from the bottom portion of the crucible, a joint disposed on the upper end portion of the stoke and connectable to a metal mold, and a pressure pipe and an exhaust pipe respectively for applying pressure to and exhausting air from the crucible chamber, wherein the crucible includes in the outer periphery thereof an induction heating device which comprises a coil to be wound round the crucible and a plurality of yokes disposed in the circumferential direction of the outer periphery of the crucible.

In the present low pressure casting machine, the crucible consists of a graphite crucible, and the coil extends to the neighborhood of the top portion of the crucible. The joint includes a plane so tapered as to correspond to the metal mold and is formed of a metal. The joint further includes a joint flange provided on the lower surface thereof and a neck provided below the joint flange. The lid includes a hole having a clearance in the radial direction thereof between the neck and itself and a lid flange slidable with the joint flange. The lid further includes in the lower surface thereof, in a portion of the inside diameter area of the crucible where the stoke is not present, a projected portion which is disposed adjacent to the highest liquid surface of the molten copper alloy. There is also provided a space filler in a space in the circumferential direction of the plurality of yokes, the pressure and exhaust pipes are respectively mounted to the lid and chamber body separately from each other, and the crucible includes a horizontally moving device and an inclining device.

Referring with FIGS. 1 and 2, since an induction heating device 14 heats the molten copper alloy 1 within a crucible 2, the temperature of the molten copper alloy 1 can be always kept within a range of casting temperature allowable values and, even when a large-sized crucible is used, small-sized brass castings can be casted quite a large number of times under low pressure until the molten copper alloy supplied is completely depleted.

In the low pressure casting, if a coil 12 is extended to the neighborhood of the top portion of the crucible 2 to prevent the magnetic flux from intersecting with the molten copper alloy, then waving of the molten metal can be reduced. If the plane 9*a* of the joint 9 is formed of a metal and is tapered so as to be in close contact with a metal mold 8, then there can be eliminated the possibility that the molten metal, such as molten copper alloy, can leak between the plane 9*a* and metal mold 8 when the molten metal is poured. If there are provided a joint flange 9*b*, a neck 9*c* disposed below the joint flange 9*b*, a hole 3*a* having a clearance in the radial direction thereof between the neck 9*c* and itself and a lid flange 3*b* slidable with the joint flange 9*b*, then the radial clearance between the neck 9*c* and hole 3*a* helps the metal mold 8 and joint 9 align with each other automatically. The joint flange 9*b* and lid flange 3*b* may slide so that the metal mold 8 can be closely contacted with the joint 9 by means of the tapered plane 9*a* thereof with ease. Further, the projected portion 17 in the lower surface of the lid 3 and the space filler 18 disposed between the yokes decrease the unavailable space of the crucible chamber 5 to thereby enhance the pressurizing and exhausting responsibility of the crucible chamber 5. Also, by mounting a pressure pipe 10 and an exhaust pipe 11 to the lid 3 and chamber body 4 separately from each other, the interiors of the crucible chamber 5 can be better scavenged due to exhaustion and pressurizing by the exhaust and pressure pipes. This eliminates the possibility that the coil 12 can be damaged by a zinc gas produced from the molten brass 1. Further, due to the fact that a horizontally moving device 20 and inclining device 30 are provided, the horizontally moving device 20 can be operated in order to throw in a cold metal charge or to receive a molten metal from a melting furnace (not shown), and the inclining device 30 can be operated when the molten metal 1 is to be discharged out for some reason.

DETAILED DESCRIPTION OF PREFERRED EMBODIMENTS

Figure 1:
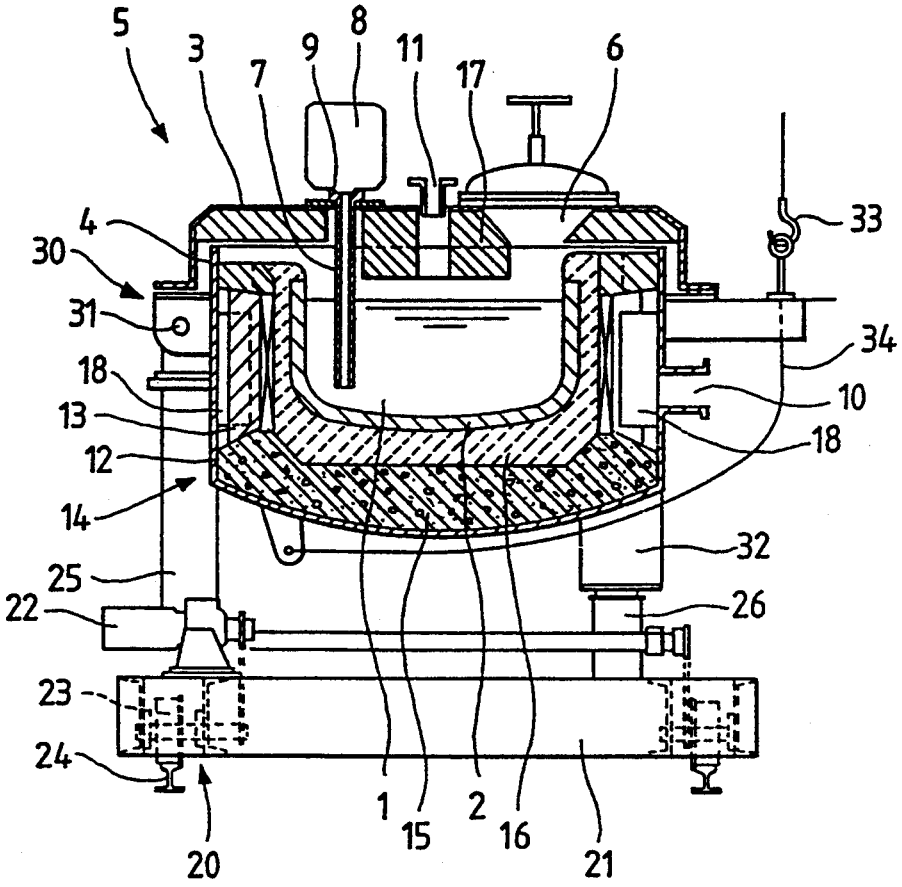
FIG. 1 is a longitudinal section view of an embodiment of a low pressure casting machine according to the invention; and, FIG. 2 is an enlarged section view of a stoke and metal mold portion of the low pressure casting machine shown in FIG. 1.
Figure 2:
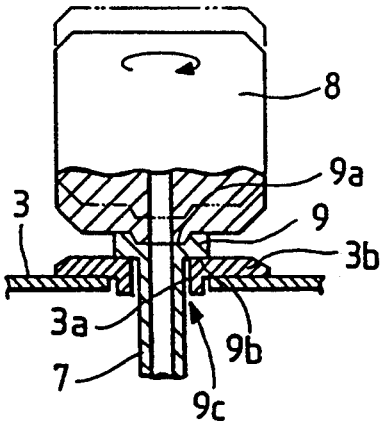

In FIG. 1, there is shown a longitudinal section view of an embodiment of a low pressure casting machine according to the invention and, in FIG. 2, there is shown an enlarged section view of a stoke and metal mold portion of the embodiment shown in FIG. 1. In the illustrated low pressure casting machine, a crucible 2, which is used to hold therein a molten metal 1 consisting of a molten copper alloy, such as molten brass or the like, is stored in a crucible chamber 5 consisting of a lid 3 and a chamber body 4 which are connected to each other in an airtight manner. The lid 3 includes a molten metal supply opening 6, which can be airtightly opened or closed and through which a cold metal charge is thrown in and the molten metal is received from a melting furnace (not shown). The lid 3 also includes a pipe-shaped stoke 7 which extends through the lid 3 and rises from the bottom portion of the crucible 2. On the upper end portion of the stoke 7 there is disposed a joint 9 which can be connected to a metal mold 8. A pressure pipe 10, which is used to apply pressure to the crucible chamber 5 to thereby pour the molten metal into the metal mold 8, and an exhaust pipe 11, which is used to exhaust the air from the crucible 5 to thereby stop pouring of the molten metal, are respectively connected to the crucible chamber 5.

The above-mentioned structure is almost the same as that of the previously described conventional low pressure casting machine. However, the illustrated embodiment of the invention is characterized in that in the outer periphery of the crucible 2 there is provided an induction heating device 14 which includes a coil 12 to be wound round the crucible 2 and a plurality of yokes 13 formed in the circumferential direction of the outer periphery of the crucible 2. The crucible 2 may be composed of a graphite crucible. If the coil 12 is extended to the neighborhood of the top portion of the crucible 2 to prevent the magnetic flux from intersecting with the molten copper alloy, then waving of the molten metal can be reduced. Heat resistant cement 15 is provided in the lower portion of a chamber body 4, and a monolithic refractory material 16 is inserted on the outer surface of the crucible 2, between the crucible 2 and coil 12, and between the crucible 2 and the heat resistant cement provided in the lower portion of the chamber body 4.

According to the above structure, due to the fact that the induction heating device 14 heats the molten metal 1 in the crucible 2, the temperature of the molten metal 1 can be always maintained within a range of casting temperature allowable values and thus, even if a large-sized crucible is used, small-sized brass castings can be cast quite a large number of times under low pressure by use of metal molds until the molten supplied is completely depleted.

Referring further to the structure of the illustrated embodiment, the joint 9 provided on the stoke 7, as shown in FIG. 2, has a plane 9*a* tapered so that it can be closely contacted with the metal mold 8 along the tapered shape thereof. The joint 9 is formed of a metal material such as ductile cast iron or the like. Further, the joint 9 includes in the lower surface thereof a joint flange 9*b* and a neck 9*c* disposed below the joint flange 9*b*, while the lid 3 includes a hole 3*a* having a clearance extending in the radial direction thereof between the neck 9*c* and itself and a lid flange 3*b* which is slidable with the joint flange 9b. Therefore, even if the metal mold 8 is placed eccentrically on the joint 9 of the stoke 7 projecting out from the lid 3 of the present low pressure casting device, the radial clearance between the neck 9c and hole 3a helps them align with each other automatically. The joint flange 9b and lid lange 3b slide, so that the metal mold 8 can be simply contacted closely with the joint 9 by means of the tapered plane 9a. Because the joint 9 is formed of a metal material, it cannot be damaged or worn when it is in contact with the metal mold, and thus the joint 9 has a long life.

If a projected portion 17 existing adjacent to the highest liquid surface of the molten metal 1 is provided in the lower surface of the lid 3, that is, in a portion of the inside diameter area of the crucible 2 where the stoke 7 does not exist, and a space filler 18 is provided in a space in the circumferential direction of the plurality of yokes 13, then the unavailable space of the crucible chamber 5 is reduced to thereby enhance the pressuring and exhausting responsibilities of the crucible chamber 5. Also, if the pressure pipe 10 and exhaust pipe 11 are mounted to the lid 3 and chamber body 4 separately from each other, then the interiors of the crucible chamber 5 can be well scavenged by the exhaustion and pressuring using the exhaust and pressure pipes, so that zinc gas produced from the molten brass 1 can be always discharged out, thereby eliminating the possibility that the coil 12 can be damaged by the zinc gas.

Also, the crucible chamber 5 of the present low pressure casting machine includes a horizontally moving device 20 and an inclining device 30. The horizontally moving device 20 comprises a wheel 23 to be driven by a reduction motor 22 provided on a base frame 21, and a rail 24. A pillar 25 and a base 26 are fixedly secured to the base frame 21. On the other hand, the inclining device 30 comprises a pin 31 for connecting one side portion of the chamber body 4 to the pillar 25, a leg 32 fixed to the other side portion of the chamber body 4 and supported by the base 26, and a wire 34 with one end thereof fixed by the chamber body 4 and the other end thereof pulled by a hook 33. In order to throw in a cold metal charge and receive molten metal from a melting furnace (not shown), the horizontally moving device 20 is operated and, when the molten metal 1 is to be discharged out for some reason, the inclining device 30 is operated.

According to the low pressure casting machine of the invention, due to the fact that the induction heating device heats the molten metal within the crucible, the temperature of the molten metal is always kept within a range of casting temperature allowable values and, even in the case of a large-size crucible, small-sized brass castings can be cast quite a large number of times under low pressure by use of metal molds until the molten metal supplied is completely depleted. In this manner, even when the casting operation is stopped with the molten metal still left in the crucible at night or on holiday, the solidified metal can be returned again to the molten metal next day, so that the casting operation can be effectively simplified.

Also, the present invention can reduce the waving of the molten metal, prevents the molten metal from leaking between the joint of the stoke and the metal mold when the molten metal is poured, and allows the joint and metal mold to be closely contacted with each other due to the above-mentioned automatic alignment action. Further, according to the invention, if the pressure pipe and exhaust pipe are mounted to the lid and chamber body separately from each other, then the interiors of the crucible chamber can be well scavenged to thereby eliminate the possibility that the coil 12 will be damaged by the zinc gas. In addition, due to provision of the horizontally moving device and inclining device, a molten metal can be produced from a cold metal charge, and a molten metal can be received from a melting furnace and the molten metal can be discharged out, if necessary.

What is claimed is:

1. A low pressure casting machine comprising:

a crucible for holding a molten metal;

a crucible chamber for storing the crucible, said crucible chamber including a lid and a chamber body connectable to each other to form an airtight engagement with the crucible stored therein;

a supply opening formed in said lid for supplying said molten metal into said crucible, the supply opening capable of being airtightly opened and closed;

a pipe-shaped stoke extending through said lid and rising from a bottom portion of said crucible;

a joint disposed on a top end portion of the stoke and connectable to a metal mold;

a pressure pipe and an exhaust pipe for applying pressure to said crucible chamber and for exhausting air from the crucible, respectively; and an induction heating device including a coil wound around an outer periphery of said crucible within the chamber body, and a plurality of yokes disposed circumferentially between the outer periphery of said crucible and an inner wall of the chamber body.

2. A low pressure casting machine as claimed in claim 1, wherein said crucible is formed of a graphite material and said coil extends proximate to a top portion of said crucible.

3. A low pressure casting machine as claimed in claim 1, wherein said joint has a tapered surface corresponding to a mating surface of said metal mold and is formed of a metal material.

4. A low pressure casting machine as claimed in claim 3, wherein said joint includes a joint flange that defines a lower surface of the joint and a neck disposed below said joint flange, and said lid includes a hole having a clearance extending in a radial direction with respect to said neck and a lid flange to be slidable with said joint flange in the radial direction.

5. A low pressure casting machine as claimed in claim 1, further including a projected portion located on a lower surface of said lid proximate an inside diameter area of said crucible where said stoke does not exist, the projected portion extending to a location adjacent to a highest elevation of said molten metal within the crucible.

6. A low pressure casting machine as claimed in claim 1, wherein a space filler is provided in a space existing circumferentially between said plurality of yokes and the inner wall of the chamber body.

7. A low pressure casting machine as claimed in claim 1, wherein said exhaust pipe and said pressure pipe are respectively mounted to said lid and said chamber body separately from each other.

8. A low pressure casting machine as claimed in claim 1, wherein said crucible chamber includes a horizontally moving device and an inclining device.

9. A low pressure casting machine comprising:

a crucible for holding a molten metal;

a crucible chamber for storing the crucible, the crucible chamber including a lid and a chamber body connectable to each other to form an airtight engagement with the crucible stored therein;

a supply opening formed in the lid for supplying the molten metal into the crucible, the supply opening capable of being airtightly opened and closed;

a pipe-shaped stoke extending through the lid and rising from a bottom portion of the crucible;

a joint disposed on a top end portion of the stoke and connectable to a metal mold, the joint includes a joint flange that defines a lower surface of the joint and a neck disposed below the joint flange, and the lid includes a hole having a clearance extending in a radial direction with respect to the neck and a lid flange to be slidable with the joint flange in the radial direction;

a pressure pipe and an exhaust pipe for applying pressure to the crucible chamber and for exhausting air from the crucible, respectively; and an induction heating device for heating the crucible.

10. A low pressure casting machine comprising:

a crucible for holding a molten metal;

a crucible chamber for storing the crucible, the crucible chamber including a lid and a chamber body connectable to each other to form an airtight engagement with the crucible stored therein;

a supply opening formed in the lid for supplying the molten metal into the crucible, the supply opening capable of being airtightly opened and closed;

a pipe-shaped stoke extending through the lid and rising from a bottom portion of the crucible;

a joint disposed on a top end portion of the stoke and connectable to a metal mold;

a pressure pipe and an exhaust pipe for applying pressure to the crucible chamber and for exhausting air from the crucible, respectively;

a projected portion located on a lower surface of the lid proximate an inside diameter area of the crucible where the stoke does not exist, the projected portion extending to a location adjacent to a highest elevation of the molten metal within the crucible; and an induction heating device for heating the crucible.

* * * * *